US006148808A

United States Patent [19]

Kainz

[11] Patent Number: 6,148,808

[45] Date of Patent: Nov. 21, 2000

[54] INDIVIDUAL CYLINDER FUEL CONTROL HAVING ADAPTIVE TRANSPORT DELAY INDEX

[75] Inventor: Jeff Leon Kainz, Sterling Heights, Mich.

[73] Assignee: Delphi Technologies, Inc., Troy, Mich.

[21] Appl. No.: 09/243,939

[22] Filed: Feb. 4, 1999

[51] Int. Cl.[7] ..... F02D 41/14

[52] U.S. Cl. ..... 123/673; 123/674

[58] Field of Search ..... 123/672, 673, 123/674, 675

[56] References Cited

U.S. PATENT DOCUMENTS

| | | | |
|---|---|---|---|
| 4,483,300 | 11/1984 | Hosaka et al. | 123/673 |
| 4,934,328 | 6/1990 | Ishii et al. | 123/673 |
| 5,651,353 | 7/1997 | Allston | 123/673 |
| 5,657,736 | 8/1997 | Maki et al. | 123/673 |
| 5,732,689 | 3/1998 | Ohno et al. | 123/673 |
| 5,947,095 | 9/1999 | Kato | 123/673 |

*Primary Examiner*—Willis R. Wolfe
*Attorney, Agent, or Firm*—Vincent A. Cichosz

[57] ABSTRACT

An improved individual cylinder fuel control method based on sampled readings of a single oxygen sensor responsive to the combined exhaust gas flow of several engine cylinders. The oxygen sensor output is sampled in synchronism with the engine firing events, a stored non-volatile table of offset values is used to correlate the sampled oxygen sensor values with individual engine cylinders, and a new offset value is determined and stored in place of a current offset value when the current offset value fails to reduce a measure of air/fuel ratio maldistribution among the engine cylinders. In systems having an oxygen sensor of the switching type, the measure of air/fuel ratio maldistribution is determined by filtering and integrating the oxygen sensor signal, and the new offset value is determined by repeatedly incrementing the stored offset value, and fueling the individual cylinders of the engine based on the incremented offset value, until the measure of air-fuel ratio maldistribution decreases. In systems having a wide-range oxygen sensor, the measure of air/fuel ratio maldistribution is determined by summing the air/fuel ratio errors identified by the sensor, and the new offset value is determined by alternately toggling a selected cylinder rich and lean, and sampling the oxygen sensor signal to identify the selected cylinder. Either way, the control adapts the stored offset values for changes that occur over time due to component degradation and variation and changes in engine hardware.

7 Claims, 3 Drawing Sheets

INDIVIDUAL CYLINDER FUEL CONTROL HAVING ADAPTIVE TRANSPORT DELAY INDEX

TECHNICAL FIELD

This invention relates to fuel control of a multi-cylinder internal combustion engine, and more particularly a control for carrying out individual cylinder fuel control with a single exhaust gas oxygen sensor.

BACKGROUND OF THE INVENTION

Effective emission control of internal combustion engine exhaust gases with a catalytic converter requires precise control of the air/fuel ratio supplied to the engine cylinders. For this purpose, it is customary to install an oxygen sensor in the engine exhaust pipe, and to use the sensor output as a feedback signal for closed-loop fuel control. Commonly, the exhaust gases of several cylinders are combined in an exhaust manifold, with a single oxygen sensor is positioned near the outlet of the exhaust manifold, and an average reading of the oxygen sensor is used as a common feedback signal for controlling the fuel supplied to each of the several cylinders.

The above-described control technique assumes a uniform air and fuel distribution among the several cylinders. However, there are frequently significant variations in air and fuel distribution among different cylinders, due to engine hardware design variations and fuel injector performance variations, for example. These variations cause the actual air/fuel ratio to significantly depart from the target air/fuel ratio, especially under transient conditions. For this reason, it has been proposed to individually control the fuel supplied to each engine cylinder; see, for example, the U.S. Pat. No. 5,651,353 to Allston, issued on Jul. 29, 1997, and assigned to the assignee of the present invention. Some systems of this type utilize multiple oxygen sensors for developing air/fuel ratio feedback signals unique to each cylinder. Some systems utilize a single oxygen sensor, but variations in the transport delay time between a cylinder exhaust port and the oxygen sensor make it difficult to correlate the sensor readings with a giver cylinder. In certain instances, transport delay variations are empirically determined for a given engine design, and stored as a fueling calibration. In other instances, mathematical models of the engine and exhaust system are used to compute individual air/fuel ratio feedback signals. The computation approach is often impractical due to through-put requirements, and both approaches suffer inaccuracy due to component variation (such as injector performance variations) and degradation over time. Further, neither approach can adapt to engine hardware changes, such as installation of a different exhaust manifold or re-location of the oxygen sensor.

SUMMARY OF THE INVENTION

The present invention is directed to an improved individual cylinder fuel control method based on sampled readings of a single oxygen sensor responsive to the combined exhaust gas flow of several engine cylinders. According to the invention, the oxygen sensor output is sampled in synchronism with the engine firing events, a stored non-volatile table of offset values is used to correlate the sampled oxygen sensor values with individual engine cylinders, and a new offset value is determined and stored in place of a current offset value when the current offset value fails to reduce a measure of air/fuel ratio distribution error among the engine cylinders.

In a first embodiment of the invention, the oxygen sensor is a switching type of sensor that toggles between a first and second states corresponding to lean and rich conditions of the sensed exhaust gas, relative to a stoichiometric air/fuel ratio. In such embodiment, (1) the new offset value is determined by incrementing the stored offset value, and fueling the individual cylinders of the engine based on the incremented offset value, until the measure of air-fuel ratio distribution error decreases, and (2) the measure of air/fuel ratio maldistribution is determined by filtering and integrating the oxygen sensor signal.

In a second embodiment of the invention, the oxygen sensor is a wide-range type of sensor that varies in amplitude about a reference value in relation to the deviation of the sensed exhaust gas from the stoichiometric air/fuel ratio. In such embodiment, (1) the new offset value is determined by alternately toggling a selected cylinder rich and lean, and sampling the oxygen sensor signal to identify the selected cylinder , and (2) the air/fuel ratio distribution error is determined by summing the rich and lean air/fuel ratio errors identified by the oxygen sensor signal.

With either embodiment, the control of the invention eliminates the drawbacks of previously known controls, such as high through-put requirements or the expense of multiple sensors, and at the same time, adapts to changes that occur over time due to component degradation and variation and changes in engine hardware.

DESCRIPTION OF THE PREFERRED EMBODIMENT

Figure 1:
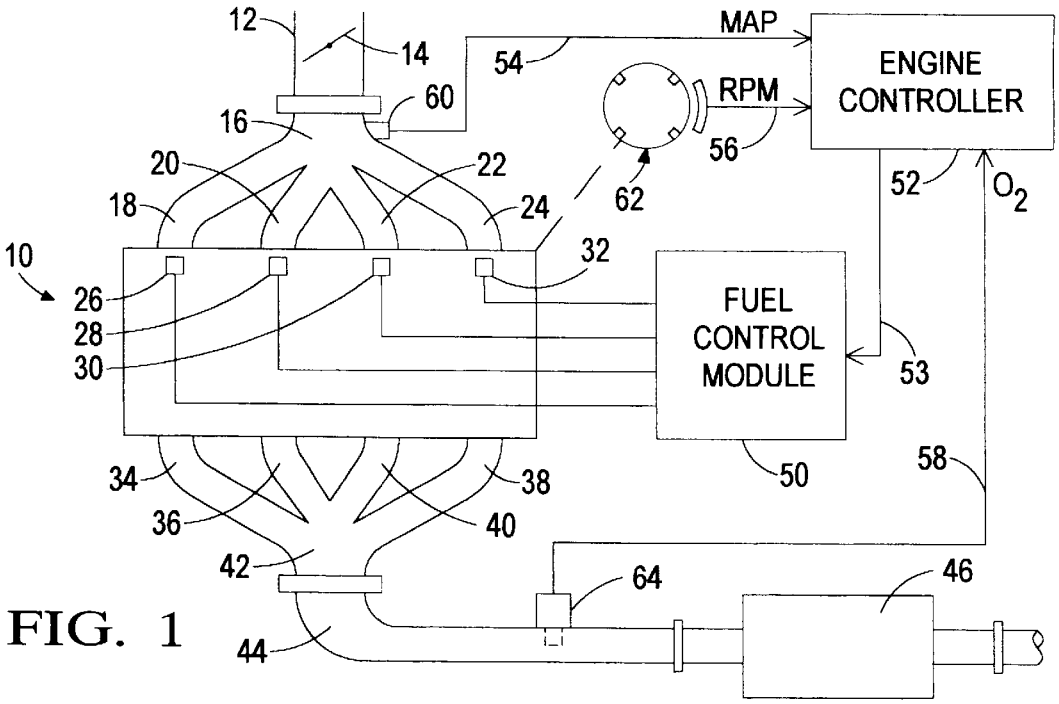
FIG. 1 is a schematic diagram of an internal combustion engines and exhaust system according to this invention, including an electronic engine control module.

Referring to the drawings, and particularly to FIG. 1, the reference numeral 10 generally designates an automotive four-cylinder internal combustion engine. Engine 10 receives intake air through an intake passage 12 that is variably restricted by a moveable throttle valve 14. Downstream of throttle valve 14, the intake air enters an intake manifold 16 for distribution to the individual engine cylinders (not shown) via a plurality of intake runners 18–24. The fuel injectors 26–32 are positioned to deliver a predetermined determined quantity of fuel to each intake runner 18–24 for combination with the intake air and admission to respective engine cylinders for combustion therein. The combustion products from each cylinder are exhausted into respective exhaust runners 34–40 of an exhaust manifold 42, and combined in an exhaust pipe 44, which in turn, is coupled to a catalytic converter 46 for emission control purposes.

The fuel injectors 26–32 are electrically activated by a fuel control module 50 under the control of a microprocessor based engine controller 52. Specifically, the controller 52 develops a fuel command pulse width, or injector on-time, for each of the engine cylinders, and provides the pulse width commands to fuel control module 50 via line 53, and the fuel control module activates the injectors 26–32 accordingly. The fuel pulse widths are determined in response to a number of inputs, including a manifold absolute pressure (MAP) signal on line 54, an engine speed (RPM) signal on line 56, and an oxygen sensor ($O_2$) signal on line 58. The MAP signal is obtained with a conventional pressure sensor 60 responsive the pressure of the intake air in intake manifold 16, the RPM signal may be obtained from a conventional crankshaft or camshaft sensor, generally designated by the reference numeral 62, and the $O_2$ signal may be obtained from a conventional exhaust gas oxygen sensor 64 responsive to the exhaust gasses in exhaust pipe 44. According to a first embodiment, the oxygen sensor 64 is of the type having an output that switches or toggles between first and second states corresponding to lean and rich conditions of the sensed exhaust gas, relative to a stoichiometric air/fuel ratio; according to a second embodiment, the sensor 64 is of the wide-range type having an output voltage that varies in amplitude about a DC offset voltage in relation to the deviation of the sensed exhaust gas from the stoichiometric air/fuel ratio.

In general, the engine controller 52 determines a base fuel pulse width as a function of the RPM and MAP signals, and other inputs such as temperature and barometric pressure. Alternatively, the base fuel pulse width may be determined based on a measure of mass air flow in the intake passage 12, using a mass air flow meter up-stream of throttle plate 14. The controller 52 then adjusts the base fuel pulse width using previously learned closed-loop corrections, which are typically stored in a electrically-erasable non-volatile look-up table of controller 52 as a function of RPM and MAP. In a global type of fuel control, the adjusted base fuel pulse width is then supplied to the fuel control module 50, which activates each of the injectors 26–32 (either sequentially or concurrently) for an on-time corresponding to the adjusted base fuel pulse width. In an individual cylinder fuel control according to this invention, however, the controller 52 develops cylinder-specific fuel pulse widths by determining a correction factor for each cylinder and applying the correction factors to the adjusted base fuel pulse width. In the case of a four-cylinder engine, for example, the controller 52 supplies four cylinder-specific fuel pulse widths to fuel control module 50, which activates the individual fuel injectors 26–32 accordingly. Individual cylinder fuel control may be used continuously, or if desired, global fuel control may be used when a measure of air/fuel ratio maldistribution is less than a predefined threshold.

As indicated above, the key in individual cylinder fuel control based on a single oxygen sensor responsive to the combined exhaust gas flow of several engine cylinders, is being able to associate sampled sensor signals with the exhaust gasses of each individual cylinder. Once the association is determined, the individual correction factors are determined as mentioned above to form the cylinder-specific fuel pulse widths. According to this invention, the output signal of the oxygen sensor is sampled in synchronism with the engine firing frequency—either one sample or multiple evenly-spaced samples per firing event—and the association between sensor samples and individual engine cylinders is in the form of an offset stored as a function of one or more engine operating conditions in a non-volatile look-up table of controller 52. In the illustrated embodiment, the oxygen sensor is sampled once at each cylinder firing event, and the offset (which may have a value of 0, 1, 2 or 3) is stored in the non-volatile look-up table as a function of RPM and MAP. Alternatively, the offsets could be stored as a function of exhaust air flow rate, possibly in combination with some other operating parameter such as intake air flow, manifold air pressure, exhaust temperature, or engine speed. For example, if the cylinder firing order is 1-3-4-2, and the offset for the current speed and load condition has a value of 0, the controller 52 associates the fourth-last sample with cylinder #1, the third-last sample, with cylinder #3, the second-last sample with cylinder #4, and the most recent sample with cylinder #2. If the offset instead had a value of 1, the controller would associate the fourth last sample with cylinder #3, the third-last sample with cylinder #4, the second-last sample with cylinder #2, and the most recent sample with cylinder #1, etc. If multiple samples are taken per cylinder firing event, N of the samples are assigned to the individual cylinders, and N(M−1) samples are not assigned to a cylinder, where M is the number of samples per cylinder, and N is the number of cylinders. Alternatively, the offset could be learned on a cylinder-by-cylinder basis.

According to another aspect of the invention, the offset look-up table is initialized to a predetermined condition prior to or at the time of installation of controller 52 in a vehicle, and thereafter, the controller periodically learns new offsets as required and stores them in the proper location of the look-up table for future use at that speed and load condition, as described above. Specifically, whenever individual cylinder fuel control is enabled, the controller 52 updates the measure of air/fuel ratio maldistribution, and determines if the cylinder-specific fueling based on the stored offset effected a decrease in the measure. If so, the offset is assumed to be correct; if not, the offset is assumed to be incorrect, and the controller 52 executes a routine to learn a new offset. If cylinder-specific fueling based on the new offset produces a decrease in the mal-distribution measure, the new offset is stored in the look-up table in place of the old offset.

Figure 2:
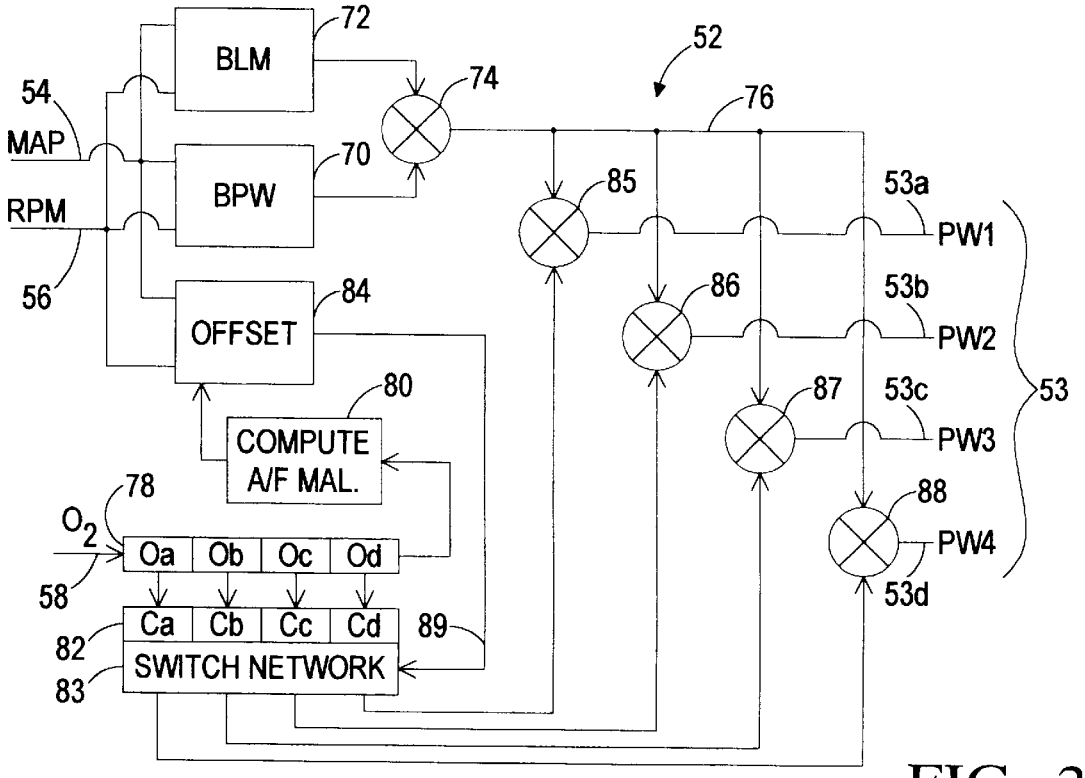
FIG. 2 is a block diagram of the control method carried out by the control module of FIG. 1 according to the invention.

The above-described control is illustrated in general for a four-cylinder engine in the block diagram of FIG. 2, where the controller 52 receives MAP, RPM and O2 inputs on lines 54, 56 and 58, respectively, and generates individual cylinder injector pulse width signals PW1, PW2, PW3, PW4 on lines 53*a*, 53*b*, 53*c* and 53*d*, respectively. A global fuel pulse width is determined as a function of MAP and RPM, using the non-volatile look-up tables 70 and 72. Table 70 is developed through extensive modeling and calibration, and provides the base pulse width, or BPW. Table 72 stores closed-loop pulse width corrections, also as a function of MAP and RPM, and is referred to herein as the block learning memory, or BLM. As is well known to those skilled in the art, the BLM table entries are determined based on the O2 input, which when adequately filtered, provides a measure of the deviation of the average engine air/fuel ratio from stoichiometry. The base pulse width and the block learning correction from tables 70 and 72 are summed at summer 74 to form a global fuel pulse width on line 76. Under conditions where the cylinder-to-cylinder air/fuel ratio distribution error is relatively low, the global fuel pulse provides adequate emission control, and may be used for each of the pulse width signals PW1–PW4. When the air/fuel ratio distribution error becomes significant, however, individual adjustment of the base pulse width signals PW1–PW4 becomes necessary to avoid increased emissions. To this end, the O2 input signal is sampled in synchronism with the engine firing frequency (one sample per cylinder in the illustrated embodiment) and the sampled values Oa, Ob, Oc and Od are stored in an observer register 78. The samples are used to compute a measure of the air/fuel ratio distribution error as indicated at block 80, and to form a correction vector for correction register 82. The correction register holds four correction values Ca, Cb, Cc and Cd, based on the observer samples Oa, Ob, Oc and Od, respectively. With constant exhaust transport delays and fueling dynamics, the individual corrections Ca, Cb, Cc and Cd would always correspond to the same engine cylinders; that is, correction Ca would always correspond to pulse width PW1 for cylinder #1, correction Cb would always correspond to pulse width PW2 for cylinder #2, and so on. As a practical matter, however, the correspondence is different under different operating conditions, and an offset is needed to correctly correlate the corrections Ca, Cb, Cc and Cd with respective engine cylinders. Thus, the correction values front register 82 are supplied to the switching network 83 which directs them to the summing junctions 85–88 based on the offset value applied to the network 83 on line 89. For example, if the offset is zero, Ca, Cb, Cc and Cd are applied to summing junctions 85, 86, 87 and 88, respectively, to form the fuel pulse width values PW1, PW2, PW3 and PW4. If the offset is one, Ca, Cb, Cc and Cd are applied to summing junctions 86, 87, 88 and 85, respectively, and so on. Conveniently, the offset values may be stored in a look-up table 84 as a function of MAP and RPM. As indicated above, and described below in connection with the flow diagrams of FIGS. 3 and 4A–4B, the offset for a particular combination of MAP and RPM may be periodically determined based on the computed air/fuel distribution error of block 80. When a new offset is determined by this process, it is written into the table 84 in place of the old value for future use at that speed and load condition.

The determination of air/fuel ratio distribution differs depending on the type of oxygen sensor. If the switching type of sensor is used, the measure of air/fuel mal-distribution is determined by applying a high-pass filter (such as a 10 Hz, second order Butterworth filter) to the oxygen sensor signal to remove the DC offset, rectifying the high-pass filter output, and integrating the rectified signal with a first-order low-pass filter to form the mal-distribution signal. If the wide-range type of oxygen sensor is used, the measure of air/fuel mal-distribution is determined by simply summing the air/fuel ratio errors produced by the sensor over a predefined measurement window.

Likewise, the routine for learning a new offset varies depending on the type of oxygen sensor used. If the switching type of sensor is used, the new offset value is determined by repeatedly incrementing the stored offset value, and fueling the individual cylinders of the engine based on the incremented offset value, until the controller locks in and the measure of air-fuel ratio distribution error decreases. If the wide-range type of oxygen sensor is used, the new offset value is determined by alternately toggling a selected cylinder (cylinder #1, for example) rich and lean, and sampling the oxygen sensor signal to identify the selected cylinder. These routines are described in further detail below in reference to the flow diagrams of FIGS. 4A and 4B.

In the manner described above, the controller 52 is able to fuel the engine cylinders individually, even under cold-start conditions, using the offset values stored in its non-volatile look-up table. As soon as the engine has warmed up and achieved a steady-state operating condition, the stored offset value may be re-learned based on the measure of air/fuel mal-distribution, with the revised offset value being stored in place of the old offset value. In this way, the control adapts the offset table for changes, whether gradual or sudden, due to aging, accumulation of foreign matter, or even changes in engine hardware.

Figure 3:
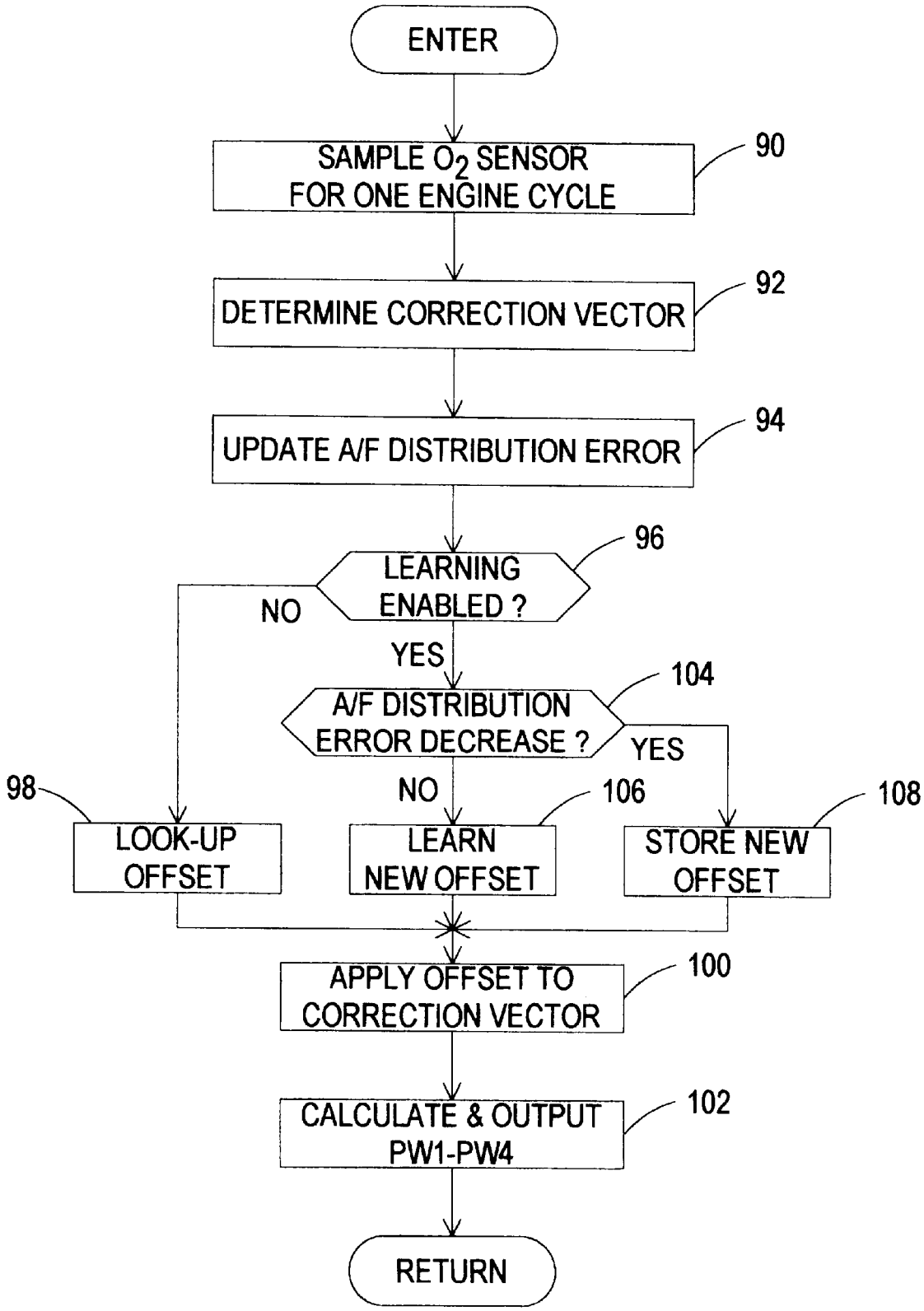
FIGS. 3, 4A and 4B are flow diagrams representative of computer program instructions executed by the control module of FIG. 1 in carrying out the fuel control of this invention.
Figure 4A:
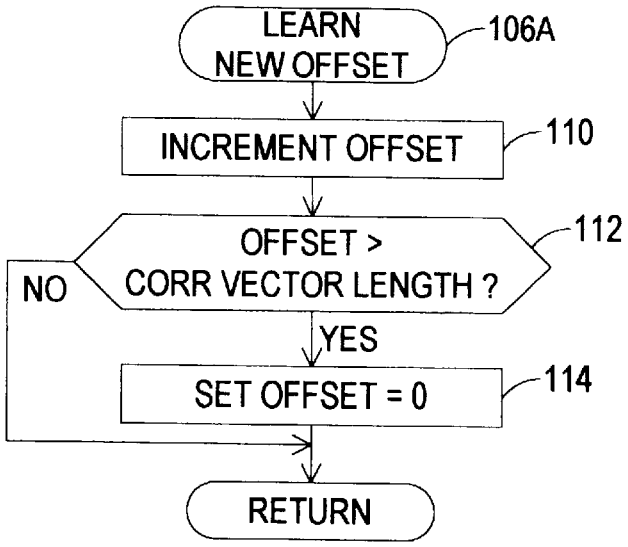
Figure 4B:
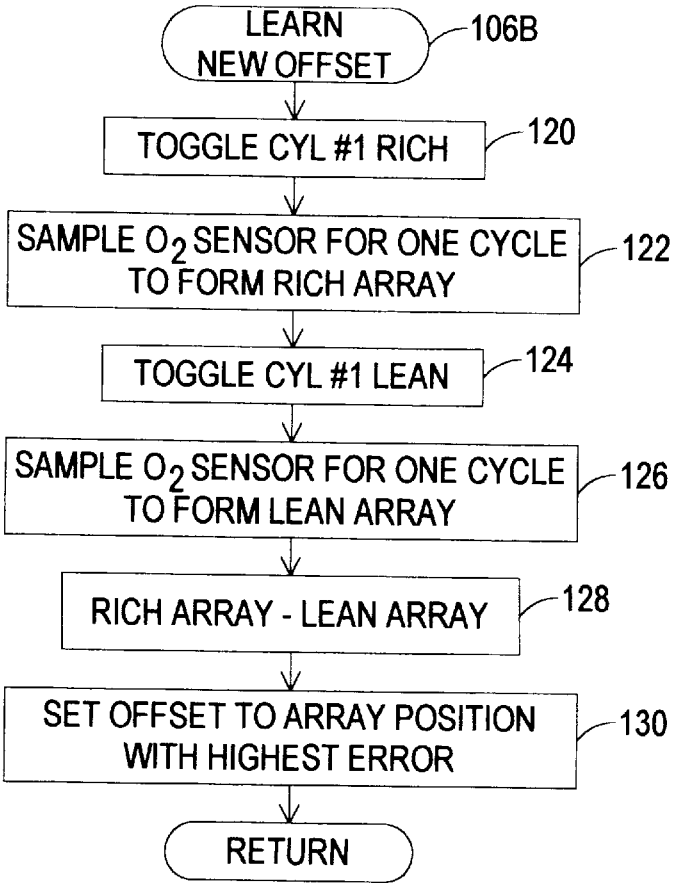

FIGS. 3, 4A and 4B are flow diagrams representative of computer program instructions executed by the controller 52 in carrying out the control of this invention. FIG. 3 is fuel pulse width routine, whereas FIGS. 4A and 4B detail the alternate methods of re-learning an offset value. Referring to FIG. 3, the blocks 90, 92 and 94 are first executed to sample the O2 sensor output, to determine a correction vector based upon the sampled values, and to update the air/fuel distribution error. The sampled values correspond to the values Oa, Ob, Oc and Od of FIG. 2, and the correction vector corresponds to the values Ca, Cb, Cc and Cd. The block 96 then determines is offset learning is enabled; in general, this involves determining if the engine is warmed up and operating under steady state conditions. If learning is not enabled, an offset value is obtained from the offset look-up table 84, as indicated at block 98, and the blocks 100–102 are executed to apply the offset value to the computed correction vector for correlating the correction values with specific engine cylinders, and to calculate and output fuel pulse widths PW1–PW4 based on the correction values and the values obtained from look-up tables 70 and 72, as described above in respect to FIG. 2.

If learning is enabled (i.e., block 96 answered in the affirmative), the block 104 is executed to determine if the updated distribution error decreased as a result of the previously computed fuel pulse widths. If so, the offset value used in the loop is confirmed, and block 108 is executed to store the offset value (if new) in the look-up table 94. The routine then continues as described above. If the distribution error fails to decrease, the blocks 106 is executed to perform an offset learning routine.

FIG. 4A sets forth the offset learning routine 106A when the oxygen sensor 64 is of the switching type. In such case, the block 110 is executed to increment the current offset, and blocks 112–114 serve to reset the offset value to zero if the incremented value exceeds the length of the correction vector. The incremented offset value is then used to determine fueling as described above, and stored as a new table entry if the level of air/fuel ratio distribution error consequently decreases. FIG. 4B sets forth the offset learning routine 106A when the oxygen sensor 64 is of the wide-range type. In such case, the blocks 120–130 are executed in sequence to: (1) toggle a designated cylinder (cylinder #1, for example) rich, deliberately reducing the air/fuel ratio of the designated cylinder; (2) sample the O2 sensor for a cycle to form a "rich array"; (3) toggle the designated cylinder lean; (4) sample the O2 sensor for a cycle to form a "lean array"; (5) subtracting the "lean array" from the "rich array"; and (6) set the offset to the array position with the highest error. The rich and lean arrays may be latched in registers such as the register 78 in FIG. 2, with the value in each place of the lean array being subtracted from the value in the same place of the rich array. The alternate toggling of a designated cylinder from rich to lean will make the a significant error in one position of the subtraction array, whereas the ether positions of the array will have near-zero error. Ordinarily, this technique identifies the offset value in one pass, and the updated air/fuel ratio distribution error in the next execution of the flow diagram of FIG. 3 will show that the distribution error decreased.

In summary, the present invention provides a method of achieving individual cylinder air/fuel control without the expense of multiple oxygen sensors or sophisticated real-time mathematical modeling. In fact, the results are superior to these approach since the value of the offset is able to change over time due to component degradation and variation and changes in engine hardware. While this invention has been described in reference to the illustrated embodiment, it is expected that various modifications in addition to those, suggested above will occur to those skilled in the art. In this regard, it will be understood that the scope of this invention is not limited to the illustrated embodiment, and that fuel controls incorporating such modifications may fall within the scope of this invention, which is defined by the appended claims.

What is claimed is:

1. A control method for fueling a plurality of individual cylinders of a multi-cylinder internal combustion engine based on an output signal of an oxygen sensor positioned to respond to a combination of exhaust gases generated in the individual cylinders, the control method comprising the steps of:

sampling the oxygen sensor output signal in synchronism with firing events in each of the individual cylinders;

computing a measure of air/fuel maldistribution among the engine cylinders based on the samples of the oxygen sensor output signal; retrieving a previously stored offset value that associates the sampled output signals with the individual cylinders;

fueling the individual cylinders based on the retrieved offset value and the sampled output signals;

updating the measure of air/fuel maldistribution; and if the updated measure of air/fuel maldistribution fails to decrease in response to the fueling based on the retrieved offset value, determining a new offset value and storing the new offset value in place of the retrieved offset value.

2. The control method of claim 1, wherein the oxygen sensor is a switching type of sensor where its output signal switches between rich and lean slates in response to the sensed exhaust gases, and the step of computing a measure of air/fuel maldistribution among the engine cylinders comprises the steps of:

high pass filtering the samples of the output signal to a high pass filter to remove a DC offset of the output signal, forming a filtered signal;

rectifying the filtered signal; and integrating the rectified filtered signal to form the measure of air/fuel maldistribution.

3. The control method of claim 1, wherein the oxygen sensor is a wide-range type of sensor where its output signal varies in magnitude about a DC offset in relation a deviation of the sensed exhaust gases from a reference, and the step of computing a measure of air/fuel maldistribution among the engine cylinders comprises the step of:

determining air/fuel ratio errors corresponding to the samples of the output signal; and summing the determined air/fuel ratio errors to form the measure of air/fuel maldistribution.

4. The control method of claim 1, wherein the previously stored offset values are stored in a non-volatile look-up table as a function of engine speed and load.

5. The control method of claim 1, wherein the oxygen sensor is a switching type of sensor where its output signal switches between rich and lean states in response to the sensed exhaust gases, and the step of determining a new offset value comprises the steps of:

incrementing the offset value;

fueling the individual cylinders based on the incremented offset value;

updating the measure of air/fuel maldistribution; and saving the incremented offset value as the new offset value if the updated measure decreases in response to the fueling based on the incremented offset value.

6. The control method of claim 5, wherein:

if the updated measure fails to decrease in response to the fueling based on the incremented offset value, repeating the steps of:

incrementing the offset value;

fueling the individual cylinders based on the incremented offset value;

updating the measure of air/fuel maldistribution; and saving the incremented offset value as the new offset value if the updated measure decreases in response to the fueling based on the incremented offset value.

7. The control method of claim 1, wherein the oxygen sensor is a wide-range type of sensor where its output signal varies in magnitude about a DC offset in relation a deviation of the sensed exhaust gases from a reference, and the step of determining a new offset value comprises the steps of:

causing a designated engine cylinder to be fueled with a richer than desired air/fuel ratio;

sampling the oxygen sensor output at the engine firing events for a complete engine cycle to form a rich sample array;

causing the designated engine cylinder to be fueled with a leaner than desired air/fuel ratio;

sampling the oxygen sensor output at the engine firing events for a complete engine cycle to form a lean sample array;

computing a difference between said rich and lean arrays;

determining the new offset value in accordance with the computed difference.

* * * * *